United States Patent [19]

Pongrass et al.

[11] 4,355,737

[45] Oct. 26, 1982

[54] FLUID DISPENSER

[76] Inventors: Robert G. Pongrass, #2A Bulkara Rd., Bellevue Hill, New South Wales, Australia; Christopher C. Rutter, 24174 Dover La., Hayward, Calif.

[21] Appl. No.: 225,788

[22] Filed: Jan. 16, 1981

[51] Int. Cl.[3] ..... B67B 7/24

[52] U.S. Cl. ..... 222/81; 222/105; 222/541; 222/536; 222/538

[58] Field of Search ..... 222/81, 82, 83, 89, 222/105, 107, 526, 534, 535, 536, 537, 538, 539, 553, 183, 541

[56] References Cited

U.S. PATENT DOCUMENTS

| | | | |
|---|---|---|---|
| 3,239,104 | 3/1966 | Scholle | 222/81 |
| 3,642,172 | 2/1972 | Malpas | 222/90 |
| 4,076,147 | 2/1978 | Schmit | 222/105 X |
| 4,314,654 | 2/1982 | Gaubent | 222/541 X |

*Primary Examiner*—Allen N. Knowles
*Attorney, Agent, or Firm*—Linval B. Castle

[57] ABSTRACT

A fluid dispenser for a bulk container for portable liquids or the like. A rigid outer box contains a sealable flexible fluid-containing plastic bag having a tubular dispenser sleeve mounted at an oblique angle to a plastic mounting fixture which is attached to the box that is also sealed to the outer surface of the fluid-containing bag. The dispenser, which is stored prior to use within the box, may be withdrawn and snapped into a horizontal position into a plastic clamp that is part of the mounting fixture and which prevents rotation of the sleeve. A turncock barrel rotatable within the dispensing sleeve has a sharp cutting tip which is normally angled with the angled end of the sleeve positioned to prevent piercing of the fluid bag. When rotated a half turn, the sharp cutting tip pierces the bag to permit the fluid to pass into the bore of the barrel and out through mating apertures in the barrel and sleeve.

9 Claims, 9 Drawing Figures

FLUID DISPENSER

CROSS-REFERENCE TO RELATED APPLICATION

The invention described and claimed herein is related to an invention disclosed in copending patent application Ser. No. 06,141,068, filed Apr. 17, 1980, now U.S. Pat. No. 4,322,018.

BRIEF SUMMARY OF THE INVENTION

This invention relates to bulk fluid containers and particularly to a novel fluid dispenser for small bulk fluid containers having a relatively rigid outer box of corrugated paper board and a flexible, sealed, fluid-containing inner bag.

Bulk containers of this type are especially valuable for the shipping, storage and dispensing of fluids that may become contaminated or otherwise deteriorated when exposed to an oxidizing atmosphere. In general, such bulk containers employ a dispenser having a flange that is attached to a bag made of a flexible plastic material that will not deleteriously affect the fluid. The bag is then filled, sealed, and placed in an outer container supporting box of corrugated cardboard or the like. If properly filled and sealed, the bag will contain no air that may damage the fluid during storage. When ready for use, a dispenser having a sharp point or cutting edge is inserted into the flange to pierce the plastic bag and provide a valved dispenser for the fluid, as described in U.S. Pat. No. 3,239,104 to Scholle or U.S. Pat. No. 3,642,172 to Melpas. As the fluid is dispensed from the container, the flexible plastic bag correspondingly shrinks in volume without admitting air. Therefore, if the container is used for the storage and dispensing of oxygen-sensitive fluids such as wine, a partially filled container may be stored for long periods of time without danger of oxidation and souring.

There are several types of bag-piercing fluid dispensers such as those described in the aforementioned patents and in the related copending patent application. All of these prior art dispensers utilize a longitudinally movable dispenser barrel having a sharpened point that is forced through a tubular sleeve to pierce the surface of the fluid bag. In some of these systems, the piercing dispenser may, through rough handling or vibration during transporting, accidentally pierce the bag to release the fluid therefrom. This may be overcome by removing the piercing element and shipping it in a separate container, resulting in the possible loss of the piercing element. The dispenser of this invention may be used to pierce the bag through longitudinal movement. It is preferable, however, to mount the piercing element into its operating position wherein a simple half-turn rotation of the turncock handle will automatically pierce the fluid-containing bag and dispense the fluid therefrom. Thus, there is little danger of accidental loss of the fluid or piercing of the bag through vibration or rough handling of the fluid container.

Briefly described, the improved dispenser of the invention includes a flexible plastic mounting fixture, one end of which is firmly mounted in an opening in a lower wall surface of the supporting box. The other end of the mounting is cemented to the surface of the plastic fluid bag and supports an angularly attached fluid dispenser sleeve. A rotatable barrel that is locked against longitudinal movement within the sleeve has a turncock handle at the outer end and an angular or oblique inner end with a sharpened cutting edge. Prior to use, the barrel is oriented within the sleeve so that the cutting edge does not touch the plastic fluid bag, but by rotating the turncock barrel one-half turn, the cutting edge pierces the bag surface to permit the fluid to flow through the bore of the barrel and out through mating holes or slots in the surfaces of the barrel and its supporting dispenser sleeve.

DESCRIPTION OF THE DRAWINGS

In the drawings which illustrate the preferred embodiment of the invention.

DETAILED DESCRIPTION OF THE PREFERRED EMBODIMENT

Figure 1:
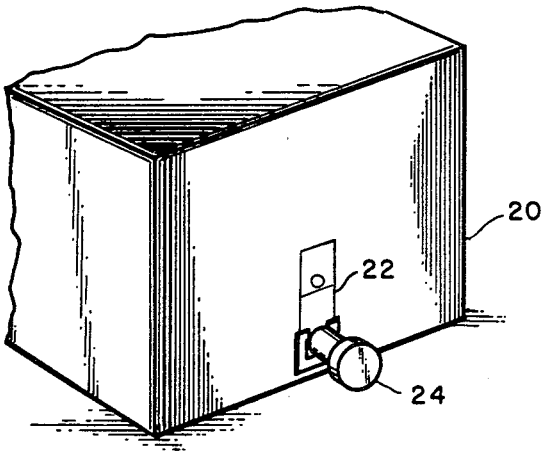
FIG. 1 is a perspective view of a portion of a fluid container box illustrating the position of the fluid dispenser.
Figure 2:
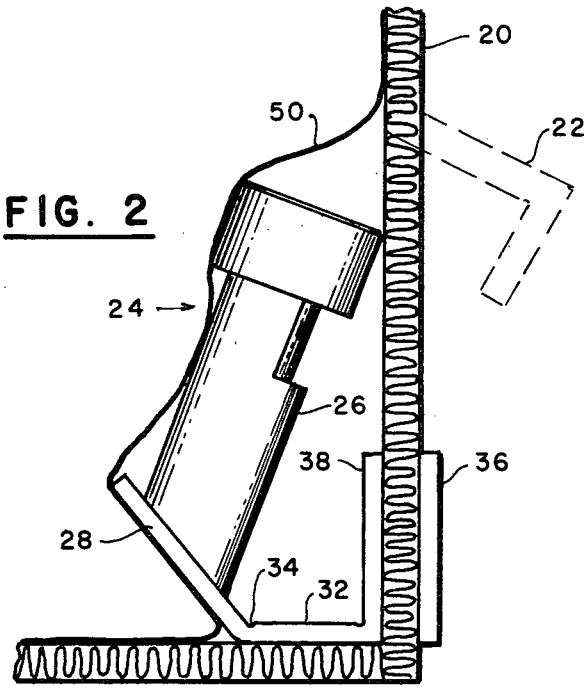
FIG. 2 is a cross-sectional elevation view illustrating the dispenser within the container.

Illustrated in the perspective view of FIG. 1 is a fluid container box 20 of corrugated paper board or similar materials having a suitable bursting strength to support a sealed inner container of a suitable plastic material containing a liquid. One side surface of the box 20 is its front surface and near the lower end of the front surface is a rectangular-shaped flap 22 scored through the wall of the container so that it may be lifted to expose a fluid dispenser 24, normally stored prior to use behind the flap 22 as illustrated in FIG. 2. The dispenser 24 is withdrawn for use as illustrated in FIG. 1 as will be subsequently described in greater detail.

As illustrated in FIGS. 2 through 5, the dispenser 24 includes a tubular sleeve 26, the inner end of which is obliquely attached to a plate 28 which forms one part of the dispenser mounting structure 30. The oblique angle between the longitudinal axis of the sleeve 26 and the plane of the plate 28 is not critical but preferably should be less than 75° to provide proper piercing of the fluid-containing plastic bag as will be described later.

Figure 5:
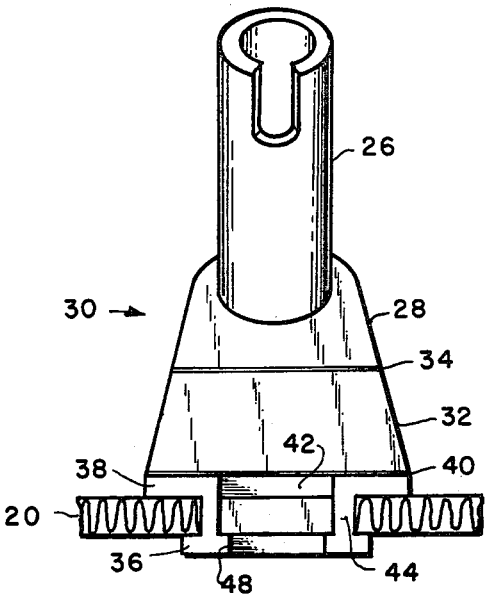
FIG. 5 is a sectional plan view illustrating the dispenser sleeve angularly attached to its foldable mounting fixture that is attached to the front of the fluid container box.
Figure 6:
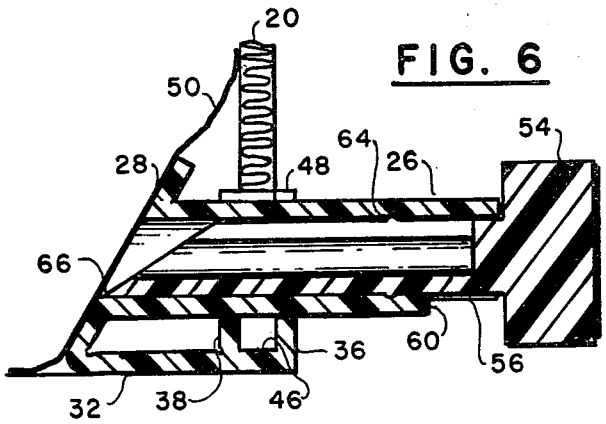
FIG. 6 is a sectional elevation view of the fluid dispenser with the turncock barrel rotated in a non-piercing position.
Figure 7:
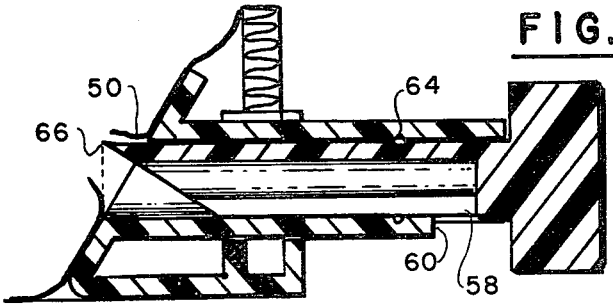
FIG. 7 is a sectional elevation view illustrating the turncock barrel in its "on" position to pierce the fluid bag.

The dispensing mounting structure 30 is preferably formed of a flexible plastic material and is comprised of the plate 28, a second plate 32 hinged to plate 28 at a fold indentation 34, and front and rear box attachment members 36 and 38, respectively, as best illustrated in FIG. 5 and the sectional views of FIGS. 6 and 7. As illustrated in FIG. 5, the rear box attachment member 38 is hinged to the second plate 32 at a fold indentation 40 and is generally U-shaped with its central opening 42 being slightly greater than the outside diameter of the dispensing sleeve 26. The front box attachment member 36 is similarly U-shaped and is parallel to and spaced from the rear member 38 by side members 44 and by a bottom portion 46 of the second plate 32 as illustrated in FIG. 6. The thickness of the slots formed by spacing between front and rear box attached members 36 and 38 is determined by and corresponds to the selected thickness of the rigid fluid container box 20 which is slotted to the floor below the flap 22 to accommodate the box attachment member.

Figure 4:
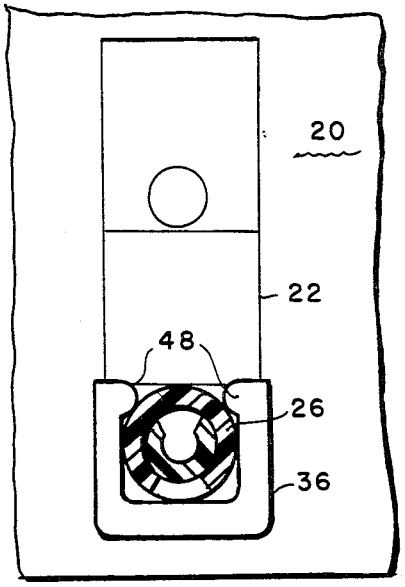
FIG. 4 is an elevation view taken along the lines 4—4 of FIG. 3.

As illustrated in FIG. 4, the central portion of the U-shaped box attached member 36 must have a width slightly larger than the outside diameter of the dispensing sleeve 26. Friction buttons 48 are provided at the top inner surface of the U-shaped attachment member 36 as illustrated in FIG. 4. The spacing between the buttons 48 is such that the dispensing sleeve may be forced between the buttons into the center of the member 36 and retained therein unless similarly forced out between the buttons. Thus the dispensing sleeve 26 may be effectively and rigidly locked into the member 36.

Figure 3:
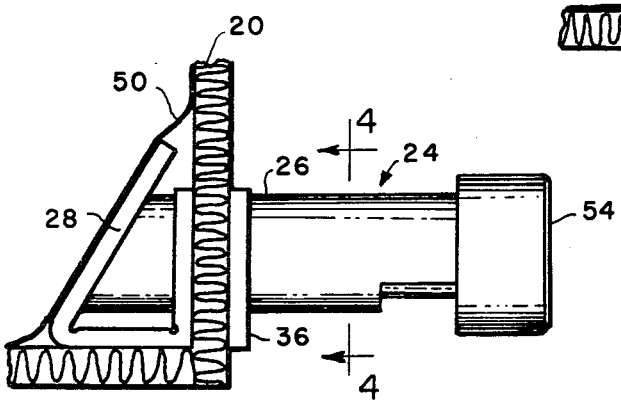
FIG. 3 is a cross-section view illustrating the dispenser locked in its working position.

Returning now to the sectional elevation view of FIGS. 2 and 3, plate 28 which has a central hole (not shown) corresponding to and coaxial with the inside diameter of the dispensing sleeve 26, is cemented or heat-sealed to the outer surface of a sealed plastic bag fluid container 50 and, during storage, is stored within the fluid-containing box 20 and behaind the box flap 22. When ready for use, flap 22 is lifted as illustrated by the dashed lines in FIG. 2 and the dispenser sleeve 26 is withdrawn and clamped by friction buttons 48 into the front box attachment member 36. Since the box attachment members 36 and 38 firmly engage a slot in the face of the box 20, the complete mounting fixture 30 along with the dispensing sleeve 26 is restrained against rotation.

Figure 8:
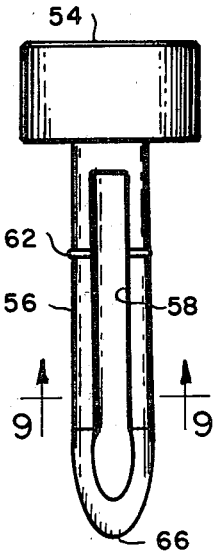
FIG. 8 is a plan view of the turncock barrel.
Figure 9:
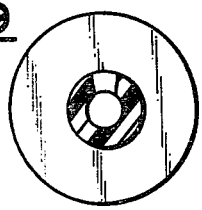
FIG. 9 is an end view of the turncock barrel taken along the lines 9—9 of FIG. 8.

FIGS. 6 and 7 are sectional elevation views illustrating the tubular dispensing sleeve 26 as a part of the plate 28 that is preferably heat-sealed to the external surface of the plastic fluid containing bag 50. As previously mentioned, the angle between the longitudinal axis of the tubular sleeve 26 and the plate 28 is preferably less than 75° as illustrated. Mounted within the bore of the tubular sleeve 26 is a tubular valve member comprising a turncock handle 54 attached to a tubular barrel 56 as best illustrated in FIG. 8. The end of the barrel 56 that is opposite the handle 54 is cut at an oblique angle which may correspond to the angle between the longitudinal axis of the tubular sleeve 26 of the plate 28 or may be at a smaller angle, as illustrated for the purpose of clarity. The extreme end portion 66 of the tubular barrel within the sleeve 26 is sharpened to provide a means for piercing the fluid container bag 50. As best illustrated in FIG. 8, the tubular barrel 56 is preferably formed with a longitudinal slot 58 which, during dispensing of the fluid, is aligned with the corresponding slot 60 near the outer end of the tubular sleeve 26 as illustrated in FIG. 7. If desired, slot 58 and the corresponding slot 60 may be replaced with dispensing holes which, when aligned, permit the fluid to flow through the bore of the tubular barrel 56 and out through the coaxial holes. The preferred embodiment, however, employs corresponding slots 58 and 60 to facilitate manufacturing of the plastic parts of the dispenser.

As illustrated in FIG. 8, a resilient annular ring 62 is molded into the exterior surface of the tubular barrel 56 and mates with a corresponding annular groove 64 within the bore of the tubular sleeve 26. The purpose of the mating ring and grooves 62 and 64 is to provide a lock of the valve member within the tubular dispensing sleeve 26 and secondarily to provide an additional seal to possible fluid leakage between the sleeve 26 and barrel 56.

To assemble the dispensing unit, the valve member sleeve 56 is forced into the tubular sleeve 26. Since all of the components are preferably formed of a flexible plastic material, the slot 58 in the tubular barrel 56 may be slightly compressed to permit the annular ring 62 to be inserted through the bore of the sleeve 26 and into the annular groove 64. The longitudinal slot 58 in the tubular barrel 56 is positioned into the top of the bore of sleeve 26 so that the cutting end 66 of the barrel does not touch the fluid container bag 50 as illustrated in FIG. 6. With the slot 58 in this position, the valve is in its "off" dispensing position. When it is desired to dispense the contents of the fluid-containing bag 50, it is only necessary to rotate the handle 54 by an angle of approximately 180° into its "on" dispensing position with the slots 58 and 60 (or holes if preferred) in open alignment. Such a rotation will cause the cutting end 66 to pierce the fluid-containing bag 50 and to enter it as illustrated in FIG. 7. Fluid is now free to flow through the bore of the tubular barrel 58 and out through the aligned dispensing slots of the barrel 56 and sleeve 26. The fluid flow may be subsequently stopped by re-rotating handle 54 so that the dispensing slots in the sleeve and barrel are no longer aligned.

We claim:

1. In combination with a bulk fluid container comprising a flexible sealed fluid containing bag supported within a rigid outer container, a fluid dispenser including:

a tubular sleeve having a first end attached to the fluid containing bag at an oblique angle and a second end extendable from the outer surface of the rigid outer container, said second end having a first fluid dispensing aperture in the lower wall of said sleeve; and a tubular valve member rotatably positioned within the bore of said tubular sleeve, the first end of said valve member being formed at an oblique angle and having a sharpened end portion, the second end of said valve member having a second fluid dispensing aperture in the wall and handle means for rotating said valve member within said sleeve between a first "off" position and a second "on" position;

in said first "off" position, said sharpened end portion of said valve member extending within said sleeve to, but not touching said fluid containing bag and said first and second fluid dispensing apertures being non-aligned; and in said second "on" position said sharpened end entering said fluid containing bag and said first and second fluid dispensing apertures being substantially aligned.

2. The fluid dispenser claimed in claim 1 wherein said fluid containing bag is pierced by said sharpened end portion by the initial rotation of said tubular valve member from its first position to its second position.

3. The fluid dispenser claimed in claim 1 wherein said fluid containing bag is pierced by the said sharpened end portion by the longitudinal insertion of said tubular valve member into the bore of said tubular sleeve while said valve member is in its second "on" rotational position.

4. The fluid dispenser claimed in claim 1 wherein said first end of said tubular sleeve is attached at an oblique angle to one surface of a first plate member, the opposite surface of said plate member being attached to said fluid containing bag.

5. The fluid dispenser claimed in claim 4 wherein said tubular valve member has a resilient annular ring around its outer surface, said ring being located to engage an annular slot in the bore of said tubular sleeve to prevent longitudinal movement of said valve member within said sleeve.

6. The fluid dispenser claimed in claim 5 further including a box attachment member having substantially parallel vertical slots in the external surface to engage a corresponding aperture in the surface of said rigid outer container and a generally U-shaped interior having a width corresponding to the external diameter of said tubular sleeve.

7. The fluid dispenser claimed in claim 6 wherein said box attachment member is hingedly connected to one edge of said first plate member whereby said fluid dispenser may be stored within said rigid outer container and may be removed from said container and locked against rotational movement in said U-shaped box attachment member.

8. The fluid dispenser claimed in claim 7 wherein said first and second fluid dispensing apertures are longitudinal slots in said second ends of said tubular sleeve and said valve member, respectively.

9. The fluid dispenser claimed in claim 7 wherein said first and second fluid dispensing apertures are holes in the walls adjacent the second ends of said tubular sleeve and said valve member, respectively.

* * * * *